US008261853B2

(12) United States Patent
Hachisuka

(10) Patent No.: US 8,261,853 B2
(45) Date of Patent: Sep. 11, 2012

(54) ERGONOMIC HANDLE FOR A POWER TOOL

(75) Inventor: Tomohiro Hachisuka, Anjo (JP)

(73) Assignee: Makita Corporation, Anjo-Shi (JP)

( * ) Notice: Subject to any disclaimer, the term of this patent is extended or adjusted under 35 U.S.C. 154(b) by 98 days.

(21) Appl. No.: 12/591,083

(22) Filed: Nov. 6, 2009

(65) Prior Publication Data

US 2010/0122825 A1 May 20, 2010

(30) Foreign Application Priority Data

Nov. 14, 2008 (JP) ..... 2008-292562

(51) Int. Cl.
*B25F 5/02* (2006.01)

(52) U.S. Cl. ..... 173/170; 173/171; 173/162.2; 173/217; 173/168; 173/169; 8/68

(58) Field of Classification Search ..... 173/162.2, 173/217, 168–169, 170–171; D8/68
See application file for complete search history.

(56) References Cited

U.S. PATENT DOCUMENTS

| | | | | |
|---|---|---|---|---|
| 3,352,368 | A * | 11/1967 | Maffey, Jr. | 173/169 |
| 4,330,093 | A * | 5/1982 | Chapman, Jr. | 242/439.3 |
| 5,829,099 | A * | 11/1998 | Kopelman et al. | 16/430 |
| 6,321,622 | B1 | 11/2001 | Tsuge et al. | |
| 6,688,407 | B2 * | 2/2004 | Etter et al. | 173/170 |
| D488,978 | S * | 4/2004 | Cheung | D8/68 |
| D566,506 | S * | 4/2008 | Aglassinger | D8/68 |
| D617,168 | S * | 6/2010 | Yamamoto et al. | D8/68 |
| 2003/0146008 | A1 * | 8/2003 | Andriolo | 173/217 |
| 2004/0078936 | A1 * | 4/2004 | Walker et al. | 16/430 |
| 2010/0096156 | A1 * | 4/2010 | Miyazawa et al. | 173/213 |
| 2010/0252293 | A1 * | 10/2010 | Lopano et al. | 173/170 |
| 2011/0079409 | A1 * | 4/2011 | Sakakibara et al. | 173/170 |

FOREIGN PATENT DOCUMENTS

EP 0 790 697 A1 8/1997

(Continued)

OTHER PUBLICATIONS

Nov. 8, 2011 European Search Report Issued in EP 09014134.2 (English translation).

(Continued)

*Primary Examiner* — Brian D Nash
*Assistant Examiner* — Michelle Lopez
(74) *Attorney, Agent, or Firm* — Oliff & Berridge, PLC

(57) ABSTRACT

It is an object of the invention to provide a fatigue reducing structure in a hand-held power tool. A representative screwdriver 100 includes a body 101, an anvil 106, a driver bit 110, a driving motor 120, a handgrip 130, a trigger 131, a rear end groove 109 pressed forward toward the driver bit 110, while being held with first and second fingers of user's hand on a housing rear end 101*a* side of the body 101, a circular arc portion 130*c* having a horizontal section of a circular arc shape on a rear end of the handgrip 130 and a middle portion 109*b* having a horizontal section of a circular arc shape on a housing rear end 101*a* side of the holding part, which circular arc shape has a curvature larger than that of the circular arc shape of the first circular arc portion.

5 Claims, 5 Drawing Sheets

FOREIGN PATENT DOCUMENTS

| | | | |
|---|---|---|---|
| EP | 1 690 649 | A1 | 8/2006 |
| EP | 2 147 754 | A1 | 1/2010 |
| JP | A-2000-167785 | | 6/2000 |
| JP | 2009-248222 | | 10/2009 |
| JP | A-2009-248222 | | 10/2009 |

OTHER PUBLICATIONS

Nov. 8, 2011 European Search Report issued in European Patent Appln. No. 09014134.2.

Office Action issued in European Patent Application No. 09 014 134.2; mailed Jun. 8, 2012.

* cited by examiner

ERGONOMIC HANDLE FOR A POWER TOOL

BACKGROUND OF THE INVENTION

1. Field of the Invention

The invention relates to a hand-held power tool.

2. Description of the Related Art

Japanese non-examined laid-open Patent Publication No. 2000-167785 discloses a portable screwdriver. Within the known screwdriver, a housing houses a motor and includes a housing barrel that extends along a rotation axis of a driver bit. A handgrip extends downward from an end of the housing barrel on the side opposite to the driver bit. During an operation of the known screwdriver, user holds the screwdriver to perform an operation selectively by holding the handgrip or by directly holding a body housing. In such circumstances, it is desired to reduce a fatigue of the user of the screwdriver.

SUMMARY OF THE INVENTION

Accordingly, it is an object of the invention to provide a fatigue reducing structure in a hand-held power tool.

Above-described object can be achieved by a claimed invention. Representative power tool according to the invention may be a hand-held power tool and include at least a body housing, a tool mounting part, a driving mechanism, a handgrip, an operating part, a holding part, a first circular arc portion and a second circular arc portion. The "power tool" here preferably includes various kinds of power tools which are used for screw-tightening, cutting, grinding, polishing, nailing, riveting, drilling or other similar operations.

The body housing is adapted to house main components including the driving mechanism. The tool mounting part is configured as a part to which a tool bit for performing a predetermined operation on a workpiece is mounted on a front end of the body housing. The driving mechanism is configured as a mechanism that is housed within the body housing and drives the tool bit. As the driving mechanism, an electric motor or a pneumatically driven mechanism may preferably be used. The driving mechanism drives the tool bit which performs a predetermined operation on a workpiece. The "tool bit" may preferably include tool bits which perform screw-tightening, cutting, grinding, polishing, nailing, riveting, drilling or other similar operations on a workpiece. Further, the tool bit may be a component of the power tool, or it may be a separate component from the power tool.

The handgrip extends from the body housing in a direction transverse to the axial direction of the tool bit and is adapted to be held by user's first to fifth fingers. The operating part (also referred to as a "trigger") is provided on a grip front portion of the handgrip and is depressed by user's finger in order to drive the driving mechanism. The holding part is pressed forward toward the tool bit, while being held with first and second fingers of user's hand on a rear end of the body housing. The first circular arc portion has a horizontal section of a circular arc shape on a rear end of the handgrip. The second circular arc portion has a horizontal section of a circular arc shape on a rear end of the holding part, and the circular arc shape of the second circular arc portion has a curvature larger than that of the circular arc shape of the first circular arc portion. The "horizontal section" is preferably defined as a plane extending along the axial direction of the tool bit. Such a power tool having both the handgrip and the holding part can be used in the first holding pattern in which the handgrip is held with all of first to fifth fingers of the user's hand and in the second holding pattern in which the rear end portion of the body housing is pressed forward toward the tool bit, while being directly held mainly with the first and second fingers of the user's hand. Specifically, in the second holding pattern, a web part between the first finger and the second finger is set on the rear end of the body housing in such a manner as to press against it.

The handgrip is configured to be held with user's first to fifth fingers according to a first holding pattern. On the other hand, the holding part is held with user's first and second fingers according to a second holding pattern. Therefore, the first circular arc portion on the rear end of the handgrip is different from the second circular arc portion on the rear end of the holding part in the circular arc configurations in order to alleviate user fatigue and pain. Specifically, in the second holding pattern, a load tends to be applied in a more concentrated manner to the web part between the first and second fingers than in the first holding pattern. Therefore, it is effective to provide the curvature of the circular arc shape of the second circular arc portion to be larger than that of the circular arc shape of the first circular arc portion. According to the invention in this respect, the curvature of the circular arc shape of the second circular arc portion is larger than that of the circular arc shape of the first circular arc portion.

With such a construction, both in the first and second holding patterns of holding the holding part, user's fatigue and pain can be alleviated.

Preferably, as another aspect of the invention, the circular arc shape of the second circular arc portion may be configured to have such a curvature that the circular arc portion is held in close contact with a web part between the first and second fingers when the holding part is held with the first and second fingers of the user's hand and to have the curvature of 22 mm or more. By this, the circular arc shape of the second circular arc portion can have a gentle curve within a range of curvatures in which the second circular arc portion is held in close contact with the web part between the first and second fingers of the user's hand when the user holds the holding part, and with a curvature of 22 mm or more.

With such configuration, when the tool is used in the second holding pattern, the second circular arc portion is almost evenly arranged along the edge of the web part between the first and second fingers of the user's hand, so that a load upon the web part can be evenly spread out over a wide area of the web part. Thus, a structure that offers less fatigue and pain in the web part can be realized.

In the power tool according to a further embodiment of the invention, preferably, the circular arc shape of the first circular arc portion is configured to have such a curvature that the circular arc portion is held in close contact with a web part between the first and second fingers when the handgrip is held with the first to fifth fingers of the user's hand, and the circular arc shape of the second circular arc portion is configured to have such a curvature that the circular arc portion is held in close contact with the web part between the first and second fingers when the holding part is held with the first and second fingers of the user's hand. Further, preferably, the ratio of the curvature of the circular arc shape of the second circular arc portion to the curvature of the circular arc shape of the first circular arc portion is 1.3 or more. With this configuration, the circular arc shape of the second circular arc portion can have a gentle curve within a range of curvatures in which the second circular arc portion is held in close contact with the web part between the first and second fingers of the user's hand when the user holds the holding part, and with a curvature 1.3 time or larger than that of the circular arc shape of the first circular arc portion.

With such configuration, when the tool is used in the second holding pattern, the second circular arc portion is arranged along the edge of the web part between the first and second fingers of the user's hand, so that a load upon the web part can be evenly spread out over a wide area of the web part. Thus, user's fatigue and pain in the web part can be alleviated According to a further aspect of the invention, the holding part may preferably have a third circular arc portion having a horizontal section of a circular arc shape and formed contiguously to the second circular arc portion on a tool side surface, and the circular arc shape of the third circular arc portion has a curvature larger than that of the circular arc shape of the second circular arc portion. The third circular arc portion can be provided at least on one of the right and left tool side surfaces contiguous to the second circular arc portion. The web part between the first and second fingers of the user's hand is set on the second circular arc portion in such a manner as to press against it, and the user's first and second fingers are set on the third circular arc portion. The third circular arc portion is provided with a circular arc shape having a gentler curve than the second circular arc portion, to the curved shape of the first and second fingers contiguous to the web part of the user's hand, in the both operations of pressing and pulling the tool in the second holding pattern.

According to an another aspect of the invention, the holding part may preferably include a recessed portion which is recessed inward in a lateral direction of the tool and formed contiguously to the third circular arc portion on the front end side of the body housing forward of the third circular arc portion. The recessed portion can be provided at least on one of the right and left tool side surfaces contiguous to the third circular arc portion. With such configuration, the holding part can be easily engaged with fingertip areas of the first and second fingers of the user's hand when the tool is used in the second holding pattern.

Other objects, features and advantages of the present invention will be readily understood after reading the following detailed description together with the accompanying drawings and the claims.

DETAILED DESCRIPTION OF THE INVENTION

Each of the additional features and method steps disclosed above and below may be utilized separately or in conjunction with other features and method steps to provide and manufacture improved power tool and method for using such power tool and devices utilized therein. Representative examples of the present invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

A representative power tool according to the invention is now described with reference to the drawings. A battery-powered screwdriver is described as an example of the hand-held power tool according to the invention.

Figure 1:
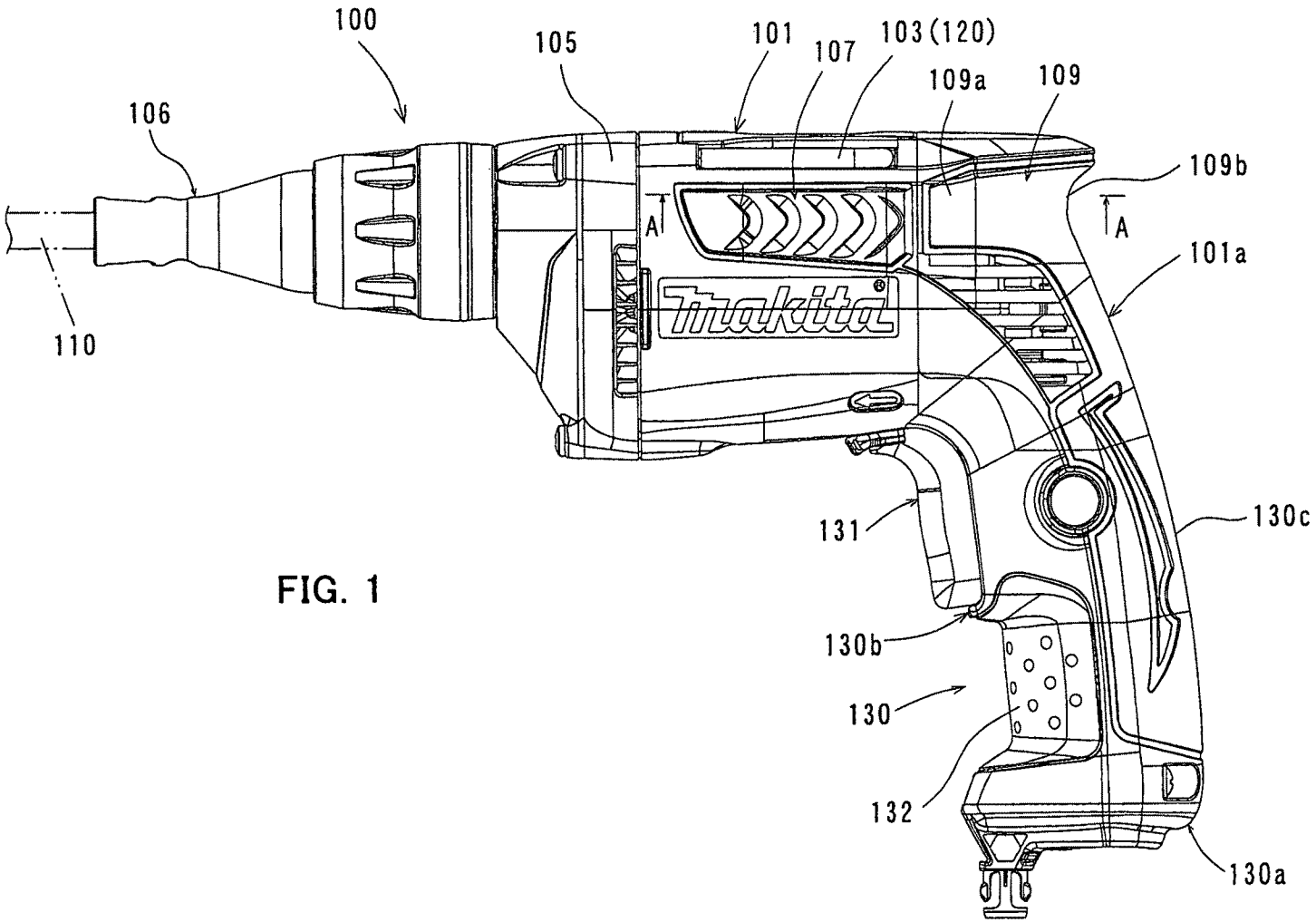
FIG. 1 is a left side view showing a screwdriver 100 according to the invention.
Figure 2:
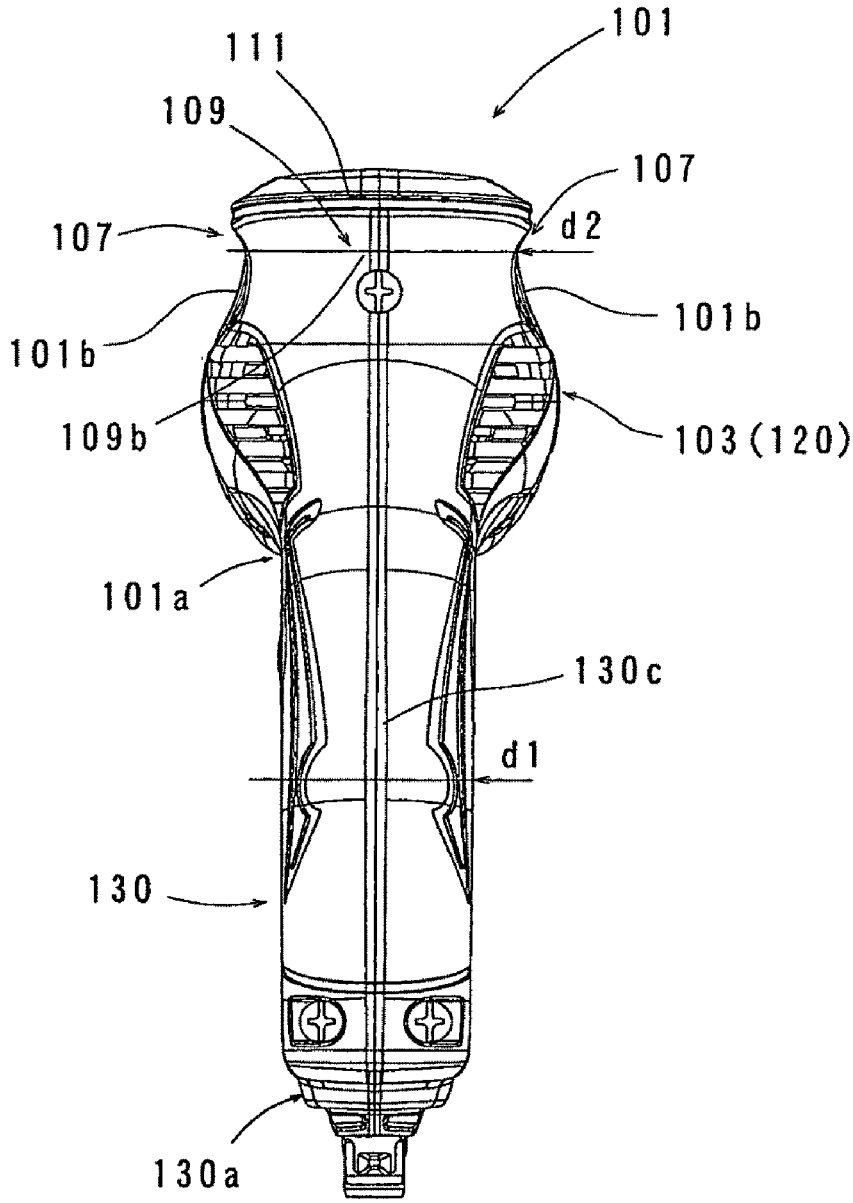
FIG. 2 is a rear view of the screwdriver 100 shown in FIG. 1.
Figure 3:
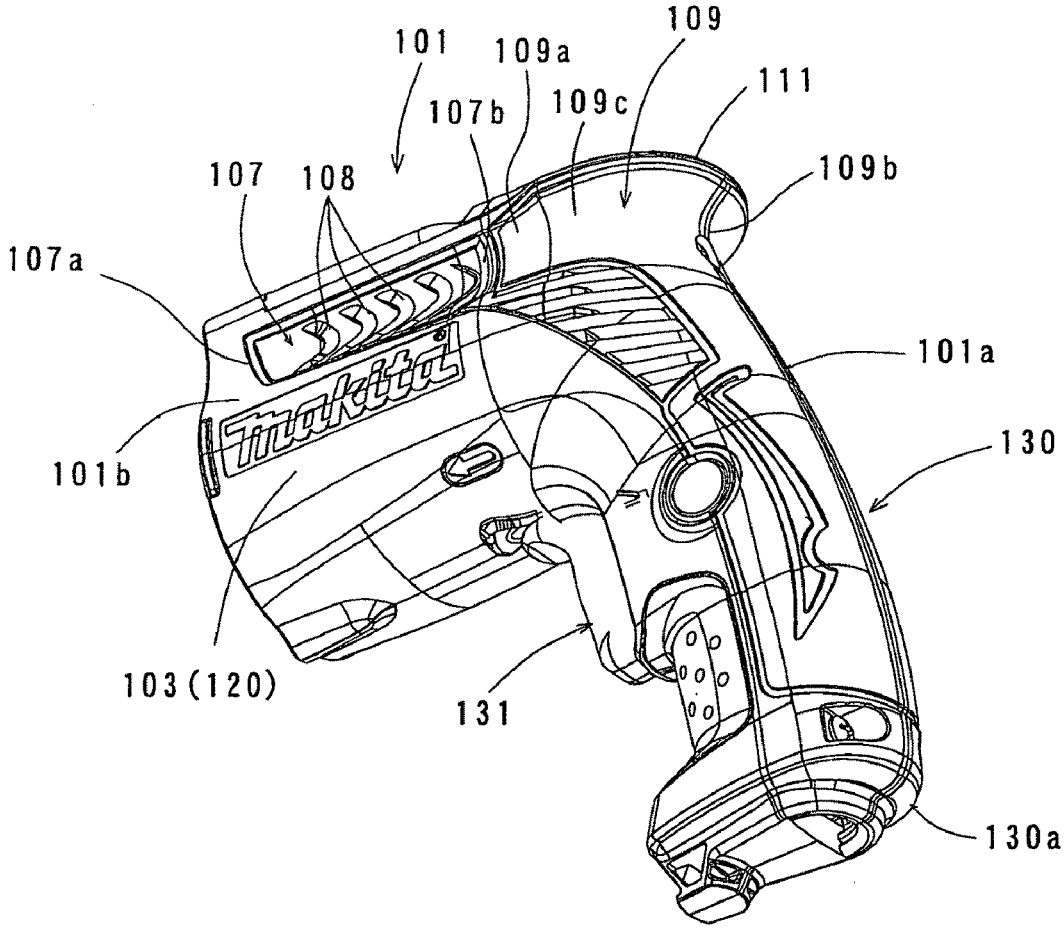
FIG. 3 is a perspective view of the back of the screwdriver 100 as viewed from obliquely downward.

FIGS. 1 to 3 show an external view of a screwdriver 100 of this embodiment. FIG. 1 is a side view of the screwdriver 100 as viewed from the left side, FIG. 2 is a rear view of the screwdriver 100 shown in FIG. 1, and FIG. 3 is a perspective view of the back of the screwdriver 100 as viewed from obliquely downward.

As shown in FIG. 1, the representative screwdriver 100 includes a body 101 that forms an outer shell of the screwdriver 100, an electric driving motor 120 for driving a driver bit 110 which performs an operation of tightening various kinds of screws and a handgrip 130. The body 101, the driving motor 120 and the handgrip 130 are features that respectively correspond to the "body housing", the "driving mechanism" and the "handgrip" according to the invention. In the present embodiment, for the sake of convenience of explanation, in the screwdriver 100, the side of the driver bit 110 is taken as the front side and the side of the handgrip 130 as the rear side.

The body 101 includes a motor housing 103 and a gear housing 105. The body 101 forms the "body housing" in this invention. The body housing of the screwdriver 100 is also referred to as being formed by the body 101 and the handgrip 130. Further, in the screwdriver 100 of this embodiment, the driver bit 110 may also be referred to as a component of the power tool.

The motor housing 103 houses the driving motor 120 that drives the driver bit 110 protruding from the front end of the gear housing 105. The driving motor 120 is a feature that corresponds to the "driving mechanism" according to this invention. The driver bit 110 that is a driven element to be driven by the driving motor 120 is a feature that corresponds to the "tool bit" according to this invention.

Although not shown, the gear housing 105 houses a speed reducing mechanism for appropriately reducing the speed of rotation of an output shaft of the driving motor 120, a spindle that is rotated by the speed reducing mechanism, a hammer that is rotated by the spindle via a transmission member in the form of balls, and an anvil 106 that is rotated by the hammer. The end of the anvil 106 protrudes from the end of the gear housing 105. The driver bit 110 is detachably mounted into this protruded end of the anvil. The anvil 106 forms a "tool mounting part" in this invention.

The handgrip 130 is a grip that is held by the user's first to fifth fingers to perform an operation or to carry the power tool. The handgrip 130 is defined as an area (region) on which the holding force (grip) of user's hand is exerted when the user holds the power tool by hand. The handgrip 130 of this embodiment extends from a housing rear end 101*a* on the body 101 side (the motor housing 103 side) to a grip end 130*a* in a direction transverse to the axial direction of the driver bit 110. A trigger 131 for throwing a power switch (not shown) of the driving motor 120 is provided on a grip front portion 130*b* (on the left side as viewed in FIG. 1) of the handgrip 130. The trigger 131 is an operating member which is depressed with user's finger to drive the driving motor 120, and releasing the trigger stops the driving motor 120. Further, a circular arc portion 130*c* having a horizontal section of a circular arc shape is provided on the grip rear end (on the right side as viewed in FIG. 1) of the handgrip 130. The "horizontal section" here is defined as a plane extending along the axial direction of the driver bit 110. As shown in FIG. 2, the handgrip 130 has a grip width d1 in the lateral direction of the tool in the circular arc portion 130*c* and its surrounding area. The handgrip 130, the trigger 131 and the circular arc portion 130*c* are features that correspond to the "handgrip", the "operating part" and the "first circular arc portion", respectively, according to this invention.

Further, in this embodiment, the body 101 including the handgrip 130 has a casing made of hard material (hard synthetic resin material or other similar material). Furthermore, a cushioning part of soft material (soft synthetic resin material, rubber material or other similar material) which is softer than the hard material is provided around the casing. The cushioning part is formed, for example, by a grip front contact portion 132 which is shown in FIG. 1. By provision of the cushioning part having such a construction, the screwdriver can provide a soft feel of grip for the user who holds the handgrip 130 and performs an operation, and can also provide an impression of being novel in appearance.

As shown in FIGS. 2 and 3, side grooves 107 are formed in right and left housing side surfaces 101*b* of the body 101 (the motor housing 103).

Each of the side grooves 107 is a recessed groove extending generally straight from a groove front end 107*a* to a groove rear end 107*b* along the axial direction of the driver bit 110. The right and left side grooves 107 are arranged on the opposed sides of the motor housing 103 of the body 101 from each other. The side grooves 107 are recessed inward in the lateral direction of the tool and formed contiguously to circular arc portions 109*c* of a rear end groove 109 (which is described below) on the front end side of the body 101 forward of the circular arc portions 109*c*. The side grooves 107 here are features that correspond to the "recessed portion" according to this invention. Further, a plurality of projections 108 are formed on the side grooves 107 and have projection components extending in a direction transverse to the extending direction of the side grooves 107. The projections 108 serve as a slip stopper when engaged with the user's fingers set on the side grooves 107.

Further, the rear end groove 109 having a horizontal section (a plane extending along the axial direction of the driver bit 110) of a circular arc shape is provided on the housing rear end 101*a* side of the body 101 (the motor housing 103).

As shown in FIG. 2, the rear end groove 109 has a section width d2 larger than the grip width d1 of the handgrip 130 in the lateral direction of the tool. The rear end groove 109 is configured as a generally C-shaped recessed groove extending from one groove end 109*a* contiguous to the groove rear end 107*b* of the one side groove 107 to the other groove end 109*a* contiguous to the groove rear end 107*b* of the other side groove 107 via a middle portion 109*b* on the housing rear end 101*a* side. Thus, the side grooves 107 are connected at the groove rear ends 107*b* to the groove ends 109*a* of the rear end groove 109. As a result, one continuously extending groove is formed which extends in a recessed form from the groove front end 107*a* of the one side groove 107 to the groove front end 107*a* of the other side groove 107 via the rear end groove 109.

Further, the rear end groove 109 has the middle portion 109*b* which has a horizontal section of a circular arc shape on the housing rear end 101*a* side of the body 101, and the curvature of the circular arc shape of the middle portion 109*b* is larger than the curvature of the circular arc shape of the circular arc portion 130*c* of the handgrip 130. Further, on right and left housing side surfaces 101*b* contiguous to the middle portion 109*b*, the circular arc portions 109*c* are provided between the middle portion 109*b* and the groove ends 109*a*. Each of the circular arc portions 109*c* has a horizontal section (a plane extending along the axial direction of the driver bit 110) of a circular arc shape and its curvature of this circular arc shape is larger than the curvature of the circular arc shape of the middle portion 109*b*. The middle portion 109*b* and the circular arc portions 109*c* are features that correspond to the "second circular arc portion" and the "third circular arc portion", respectively, according to this invention. Further, a flange 111 (projection) is formed on the upper end of the rear end groove 109 and overhangs in a flange-like form in the direction of the opening of the rear end groove 109 (laterally and rearward from the tool).

In the screwdriver 100 having the above-mentioned construction, when the user holds the handgrip 130 and depresses the trigger 131 to throw the power switch, the driving motor 120 is driven. The driver bit 110 is then rotated via the speed reducing mechanism, the spindle, the hammer and the anvil and performs a screw-tightening operation. The operating principle of the screwdriver 100 itself is known in the art, and therefore its construction and operation will not be described in detail.

Conceivable operation manners using the screwdriver 100 include the manner of performing an operation while pressing forward the driver bit 110 held in a horizontally extending position, the manner of performing an operation while pressing upward or downward the driver bit 110 held in a vertically extending position, and the manner of performing an operation while pressing upward or downward the driver bit 110 held in a obliquely extending position.

In this embodiment, the screwdriver 100 can be used in first and second holding patterns in each of the above-described operation manners. The first holding pattern is defined as a pattern in which the handgrip 130 among parts of the screwdriver 100 is held with all of first to fifth fingers of the user's hand. The second holding pattern is defined as a pattern in which the rear end portion of the body 101 among parts of the screwdriver 100 is pressed forward toward the driver bit 110, while being held mainly with the first and second fingers of the user's hand.

Figure 4:
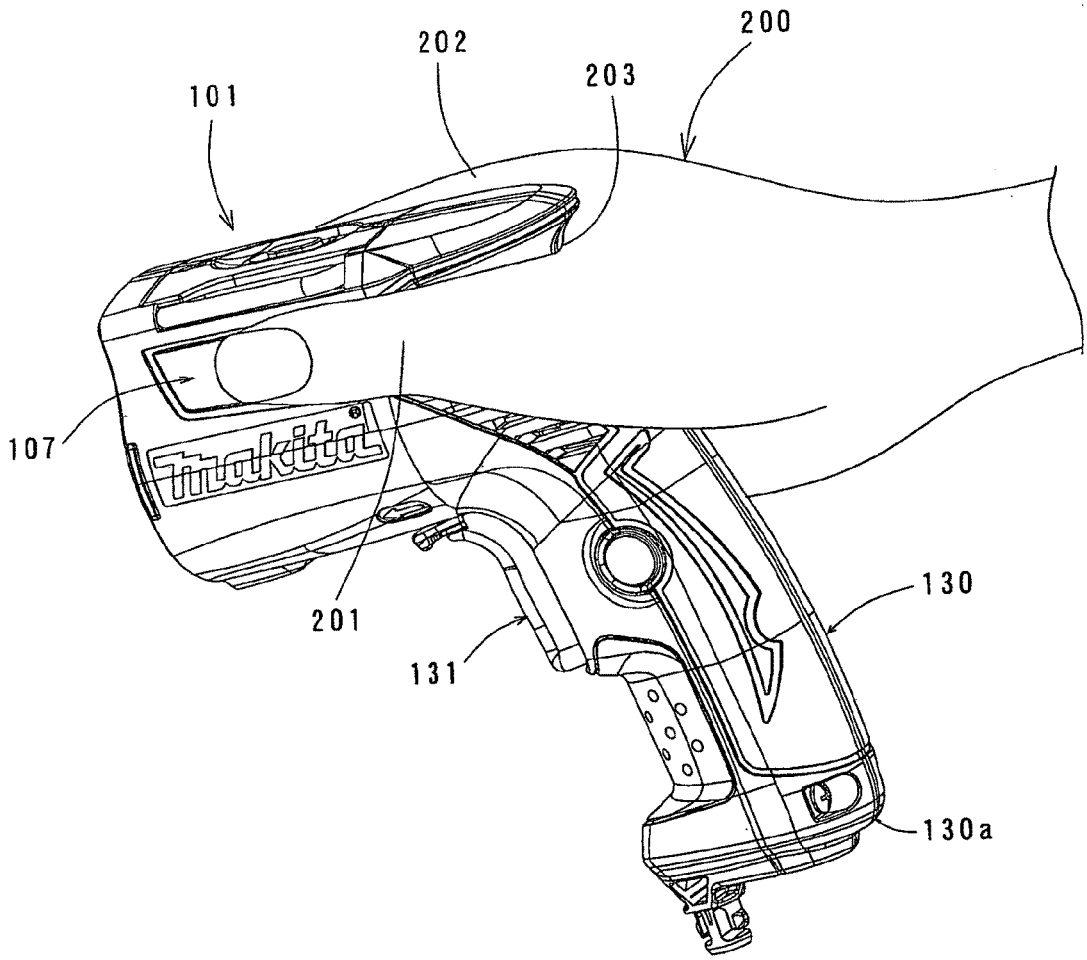
FIG. 4 is a perspective view showing a second holding pattern in which a rear end portion of a body 101 of the screwdriver 100 of this embodiment is held by the user.
Figure 5:
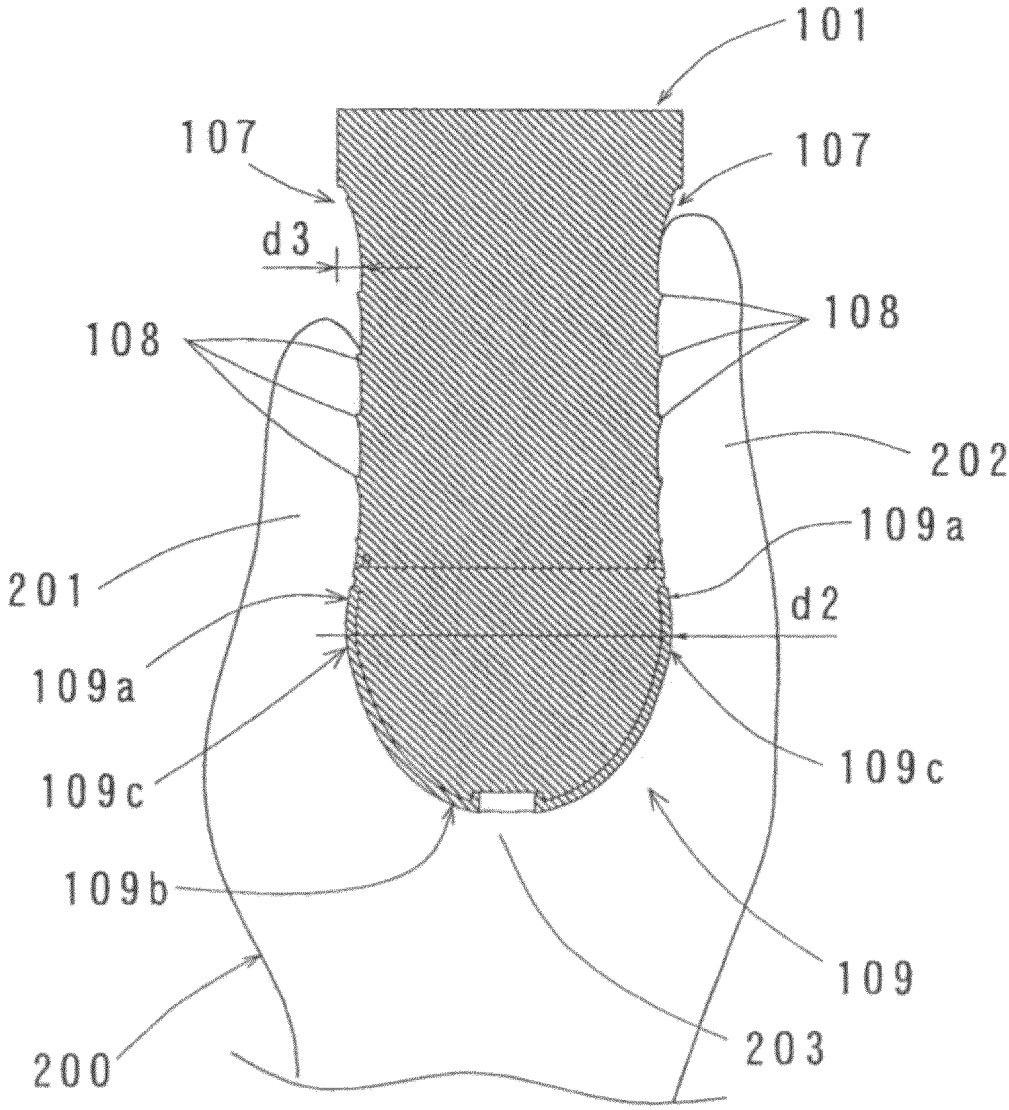
FIG. 5 is a partial sectional view taken along line A-A in FIG. 1, showing the second holding pattern shown in FIG. 4 as viewed from above the tool.

An example of the second holding pattern is shown in FIGS. 4 and 5. Here, FIG. 4 is a perspective view showing the second holding pattern in which the rear end portion of the body 101 of the screwdriver 100 of this embodiment is held by the user. FIG. 5 is a partial sectional view taken along line A-A in FIG. 1, showing the second holding pattern shown in FIG. 4 as viewed from above the tool.

As shown in FIGS. 4 and 5, in the second holding pattern, a first finger (thumb) 201 and a second finger (index finger or forefinger) 202 of a hand 200 of the user are set on the right and left side grooves 107 in such a manner as to hold them between the fingers, and a web part 203 between the first finger 201 and the second finger 202 is set on the rear end groove 109 in such a manner as to press against it. The side grooves 107 and the rear end groove 109 on the housing rear end 101*a* side of the body 101 form an area which is pressed forward toward the driver bit 110 while being held by the first finger 201 and the second finger 202 of the user's hand 200. Therefore, the side grooves 107 and the rear end groove 109 form the "holding part" in this invention. Further, in this second holding pattern, although not shown, preferably, a third forger (middle finger) of the user's hand 200 is set on the housing side surface 101*b* on the second finger 202 side of the body 101, and a fourth finger (ring finger) and a fifth finger (little finger) of the user's hand 200 are set on the trigger 131 of the handgrip 130.

In the second holding pattern, the user's fingers are set on the axis of the driver bit 110 and press against the tool from behind, so that the driver bit 110 can be pressed hard against the workpiece. Therefore, the second holding pattern is effective in easily performing an operation on a relatively hard workpiece. Further, in the second holding pattern, fingertip areas of the first finger 201 and the second finger 202 of the user's hand 200 are engaged in the side grooves 107 and further prevented from slipping by the projections 108 of the side grooves 107. Therefore, the second holding pattern is also effective in preventing slippage of the tool with respect to the first finger 201 and the second finger 202 of the user's hand 200. For this purpose, preferably, the depth of the side grooves 107 (preferably, a groove depth d3 between the top of the circular arc portion 109*c* and the bottom of the side groove 107 in FIG. 5) is set to 1.0 mm or more. By thus setting, an occurrence of slippage of the tool with respect to the first finger 201 and the second finger 202 of the user's hand 200 can be more reliably prevented in the second holding pattern.

Further, in the second holding pattern, the flange 111 covers an upper part of the first finger 201 and the second finger 202 between which the right and left side grooves 107 are held. Thus, the flange 111 prevents the first and second fingers 201, 202 from becoming disengaged upward from the side grooves 107. Further, the flange 111 is effective in providing the user with a feeling of security.

In a power tool such as a screwdriver 100 having the above described construction, as for the configuration of the rear end portion of the body 101 which is held with the first finger 201 and the second finger 202 of the user's hand 200, it is desired to provide a fatigue reducing structure that can offer less user fatigue and pain.

With this respect, the handgrip 130 is configured to be held with user's first to fifth fingers, whereas the side grooves 107 and the rear end groove 109 are held with user's first and second fingers. Therefore, the circular arc portion on the rear end of the handgrip 130 (the circular arc portion 130*c*) is different from the circular arc portion on the rear end of the rear end groove 109 (the middle portion 109*b*) in the circular arc configurations which offer less user fatigue and pain. Specifically, in the second holding pattern, a load tends to be applied in a more concentrated manner to the web part between the first and second fingers than in the first holding pattern. Therefore, it is effective if the curvature of the circular arc shape of the middle portion 109*b* of the rear end groove 109 is larger than that of the circular arc shape of the circular arc portion 130*c* of the handgrip 130. Here, the circular arc portion 130*c* of the handgrip 130 is designed to have a circular arc shape having such a curvature that the circular arc portion is held in close contact with the web part between the first and second fingers when the handgrip 130 is held with the first to fifth fingers of the user's hand. Further, the middle portion 109*b* of the rear end groove 109 is designed to have a circular arc shape having such a curvature that the middle portion is held in close contact with the web part between the first and second fingers when the housing rear end 101*a* side of the body 101 is held with the first and second fingers of the user's hand.

With such a construction, both in the first holding pattern of holding the handgrip 130 and in the second holding pattern of holding the side grooves 107 and the rear end groove 109, the holding structure that can offer less user fatigue and pain can be realized.

Further, inventors of this invention have successfully found that, if the curvature of the circular arc shape of the middle portion 109*b* of the rear end groove 109 is more appropriately set within a range of curvatures in which the middle portion is held in close contact with the web part between the first and second fingers, such configuration is effective in reducing fatigue and pain in the first and second fingers from which the user suffers by contact with the middle portion 109*b* of the rear end groove 109 during an operation of pressing the tool. Further, it has also been found to have an effect that the housing rear end 101*a* side of the body 101 is more easily held even during an operation of pulling the tool. Specifically, in the rear end groove 109 on the rear end 101*a* side of the body 101, particularly, the middle portion 109*b* is preferably configured to have a circular arc shape having a curvature of 22 mm or more. With such configuration, in use of the tool in the second holding pattern, the middle portion 109*b* of the rear end groove 109 is almost evenly arranged along the edge of the web part between the first and second fingers of the user's hand, so that a load upon the web part can be evenly spread out over a wide area of the web part. Further, the maximum curvature of the circular arc shape of the middle portion 109*b* can be set, for example, to 30 to 35 mm in consideration of the width of the body 101.

Further, when setting the curvature of the circular arc shape of the middle portion 109*b* as described above, inventors have conducted quantitative evaluations of fatigability of the user's hand in use of the holding structures of an working example and a comparative example. Measurements and evaluations have been made on criterion A (muscle load ratio) and criterion B (holding force or also referred to as "power factor").

(Holding Structures of Working Example and Comparative Example)

In a screwdriver used in a working example, the middle portion 109*b* of the rear end groove 109 has a circular arc shape having a curvature of 22 mm or more, while, in a screwdriver used in a comparative example, it has a curvature of about 17 mm. Further, the screwdrivers of the working example and the comparative example have almost the same masses both in the range of 3.0 to 3.2 kg.

(Criterion A)

In measuring the muscle load ratio of criterion A, electrodes of a known surface electromyograph are attached onto areas (skin surface) of the subject's arm to be measured. The subject holds the housing rear end 101*a* side (the side grooves 107 and the rear end groove 109) of the body 101 for a fixed period of time, and in this state, the muscle potential on the skin surface is measured. As the areas of the subject's arm to be measured, four of the muscles of the arm, or extensor carpi ulnaris muscle, flexor carpi ulnaris muscle, brachioradial muscle and flexor carpi radialis muscle are selected. These four muscles are known as muscles which have an effect particularly on the grip of the fingers or the hand. The ratio of the muscle potential of the working example to that of the comparative example is defined as the "muscle load ratio (%)" in this embodiment.

(Criterion B)

In measuring the holding force of criterion B, the tool tip is connected to a tensile load measuring device and the subject pulls it while holding the housing rear end 101*a* side of the body 101 (the side grooves 107 and the rear end groove 109), and at this time, the tensile load is measured by the tensile load measuring device. The ratio of the tensile load of the working example with respect to that of the comparative example is defined as the "holding force (%)" in this embodiment.

The calculation results of the muscle load ratio of the subject on the criterion A show that the muscle potential is lower in the working example than that in the comparative example, and it is verified that, in the working example, the muscle load ratio is reduced to about 50 to 80% of that in the comparative example. It is known that the degree of the muscle potential generally correlates with the degree of the muscle activity and the muscle potential gets higher by performing an action that requires higher muscular power or kinetic energy. Therefore, for workload assessments or job improvements, it is judged that a job which can be done with a lower muscle potential can be done with a lower workload, or with a weaker grip. Thus, it has been quantitatively verified that a job improvement can be made in such a degree as to reduce the muscle load ratio by about 20 to 50% when, in the rear end groove 109 on the rear end 101*a* side of the body 101, particularly, the middle portion 109*b* is configured to have a circular arc shape having a curvature of 22 mm or more.

Further, the calculation results of the holding force of the subject on the criterion B show that the holding force is about 1.7 to 1.8 time stronger in the working example than that in the comparative example. Thus, it has been quantitatively verified that a job improvement can be made such that a work can be done with a weaker holding force when, in the rear end groove 109 on the rear end 101*a* side of the body 101, particularly, the middle portion 109*b* is configured to have a circular arc shape having a curvature of 22 mm or more.

By using the screwdriver 100 of the above-described embodiment, when, in the rear end groove 109 on the rear end 101*a* side of the body 101, the middle portion 109*b* is configured to have a circular arc shape having a curvature of 22 mm or more, a structure can be realized which offers less user fatigue and pain in the second holding pattern in which the user holds the rear end side of the body housing.

In relation to this configuration, in this embodiment, the ratio of the curvature of the circular arc shape of the middle portion 109*b* of the rear end groove 109 to the curvature of the circular arc shape of the circular arc portion 130*c* of the handgrip 130 can be set to 1.3 or more. With this configuration, the circular arc shape of the middle portion 109*b* can have a gentle curve within a range of curvatures in which the middle portion is held in close contact with the web part between the first and second fingers of the user's hand when the user holds the rear end 101*a* side of the body 101, and with a curvature 1.3 time or larger than that of the circular arc shape of the circular arc portion 130*c*. With such configuration, when the tool is used in the second holding pattern, the middle portion 109*b* is arranged along the edge of the web part between the first and second fingers of the user's hand, so that a load upon the web part can be evenly spread out over a wide area of the web part. Thus, a structure that offers less fatigue and pain in the web part can be realized.

Further, in this embodiment, the ratio of the section width d2 of the circular arc portion 109*c* of the rear end groove 109 in the lateral direction of the tool to the grip width d1 of the circular arc portion 103*c* of the handgrip 130 in the lateral direction of the tool can be set to 1.3 or more. With this configuration, a structure can also be realized which offers less user fatigue and pain in the second holding pattern in which the user holds the housing rear end 101*a* side of the body 101.

Further, according to this embodiment, the web part 203 between the first finger 201 and the second finger 202 of the user's hand is set on the middle portion 109*b* of the rear end groove 109 in such a manner as to press against it, and the first finger 201 and the second finger 202 are set on the circular arc portions 109*c* of the rear end groove 109. Therefore, the holding structure of the rear end groove 109 is realized in which the middle portion 109*b* of the rear end groove 109 offers less fatigue and pain in the web part 203 of the user's hand and in which the circular arc portions 109*c* of the rear end groove 109 easily conform, with a circular arc shape having a gentler curve than the middle portion 109*b*, to the curved shape of the first and second fingers 201, 202 contiguous to the web part 203 of the user's hand, in the both operations of pressing and pulling the tool in the second holding pattern.

Further, according to this embodiment, by provision of the side grooves 107 which are recessed inward in the lateral direction of the tool and formed contiguously to the circular arc portions 109*c* of the rear end groove 109 on the tool front side of the circular arc portions 109*c*, the holding structure is realized which is easily engaged with the fingertip areas of the first finger 201 and the second finger 202 of the user's hand.

OTHER EMBODIMENT

The invention is not limited to the above embodiment, but rather, may be added to, changed, replaced with alternatives or otherwise modified. For example, the following provisions can be made in application of this embodiment.

In the above embodiment, with regard to the configuration of the housing rear end 101*a* side of the body 101, the circular arc portions 109*c* are described as having a circular arc shape with a curvature larger than that of the circular arc shape of the middle portion 109*b* and as being provided on the tool front side of the middle portion 109*b* of the rear end groove 109. In this invention, however, the curvature of the circular arc shape of the circular arc portions 109*c* can be appropriately selected regardless of the correlation with the curvature of the circular arc shape of the middle portion 109*b*. Further, in this invention, at least one of the right and left circular arc portions 109*c* may be dispensed with as necessary.

Further, in the above embodiment, with regard to the configuration of the housing rear end 101*a* side of the body 101, the side grooves 107 are described as being recessed inward in the lateral direction of the tool and formed contiguously to the circular arc portions 109*c* of the rear end groove 109 on the tool front side of the circular arc portions 109*c*. In this invention, however, at least one of the right and left side grooves 107 may be dispensed with as necessary.

Further, in the above embodiment, the screwdriver 100 for use in screw-tightening operation is described as a representative embodiment of the power tool, but this invention is not limited to the screwdriver 100. It can be applied to various other power tools which are used for cutting, grinding, polishing, nailing, riveting or drilling. At this time, a tool bit driving method may be appropriately selected, such as a method of driving the tool bit by a driving motor which is powered through an AC power or a battery, and a method of driving the tool bit by air or gas pressure. In short, the invention can be applied to various power tools which can be used both in the first holding pattern in which the handgrip is held with all of first to fifth fingers of the user's hand and in the second holding pattern in which the rear end portion of the body housing is pressed forward toward the tool bit, while being directly held mainly with the first and second fingers of the user's hand.

Further, in view of the description of the above embodiment and modifications, the invention can be provided with the following features.

"A hand-held power tool with a body housing, a tool mounting part to which a tool bit for performing a predetermined operation on a workpiece is mounted on a front end of the body housing, a driving mechanism that is housed within the body housing and drives the tool bit, a handgrip that extends from the body housing in a direction transverse to the axial direction of the tool bit and is designed to be held by user's first to fifth fingers, an operating part that is provided on a grip front portion of the handgrip and is depressed by user's finger in order to drive the driving mechanism, a holding part which is pressed forward toward the tool bit, while being held with first and second fingers of user's hand on a rear end of the body housing, and a circular arc portion having a horizontal section of a circular arc shape on a rear end of the holding part, wherein the circular arc shape of the second circular arc portion is configured to have such a curvature that the circular arc portion is held in close contact with a web part between the first and second fingers when the holding part is held with the first and second fingers of the user's hand and to have the curvature of 22 mm or more."

"A hand-held power tool with a body housing, a tool mounting part to which a tool bit for performing a predetermined operation on a workpiece is mounted on a front end of the body housing, a driving mechanism that is housed within the body housing and drives the tool bit, a handgrip that extends from the body housing in a direction transverse to the axial direction of the tool bit and is designed to be held by user's first to fifth fingers, an operating part that is provided on a grip front portion of the handgrip and is depressed by user's finger in order to drive the driving mechanism, a holding part which is pressed forward toward the tool bit, while being held with first and second fingers of user's hand on a rear end of the body housing, a first circular arc portion having a horizontal section of a circular arc shape on a rear end of the handgrip, and a second circular arc portion having a horizontal section of a circular arc shape on a rear end of the holding part, wherein the ratio of a section width of the circular arc shape of the second circular arc portion in a lateral direction of the tool to a section width of the circular arc shape of the first circular arc portion in a lateral direction of the tool is 1.3 or more."

"The power tool as defined in claim 5, wherein the recessed portion is recessed 1.0 mm or more inward with respect to the third circular arc portion."

DESCRIPTION OF NUMERALS

100 screwdriver (power tool)
101 body
101*a* housing rear end
101*b* housing side surface
103 motor housing
105 gear housing
106 anvil
107 side groove
107*a* groove front end
107*b* groove rear end
108 projection
109 rear end groove
109*a* groove end
109*b* middle portion
109*c* circular arc portion
110 driver bit (tool bit)
111 flange
120 driving motor
130 handgrip
130*a* grip end
130*b* grip front portion
130*c* circular arc portion
131 trigger
132 grip front contact portion
200 hand
201 first finger
202 second finger
203 web part

What I claim is:

1. A hand-held power tool comprising:

a body housing, a tool mounting part to which a tool bit is mounted, the tool mounting part provided on a front end of the body housing, a driving mechanism that is housed within the body housing and drives the tool bit, a handgrip that extends from the body housing in a direction transverse to the axial direction of the tool bit, the handgrip being held by user's first to fifth fingers, an operating part that is provided on a grip front portion of the handgrip and is depressed by user's finger to drive the driving mechanism, a holding part which is pressed forward toward the tool bit, while being held with first and second fingers of user's hand on a rear end of the body housing, a first circular arc portion having a horizontal section of a circular arc shape extending in an axial direction relative to the tool bit on a rear end of the handgrip and a second circular arc portion having a horizontal section of a circular arc shape extending in an axial direction relative to the tool bit on a rear end of the holding part, the circular arc shape having a curvature larger than the curvature of the circular arc shape of the first circular arc portion, wherein the circular arc shape of the second circular arc portion is configured to have a curvature ranging from 30 mm to 35 mm.

2. The power tool as defined in claim 1, wherein the circular arc shape of the first circular arc portion is configured to have such a curvature that the circular arc portion is held in close contact with a web part between the first and second fingers when the handgrip is held with the first to fifth fingers of the user's hand, and the circular arc shape of the second circular arc portion is configured to have such a curvature that the circular arc portion is held in close contact with the web part between the first and second fingers when the holding part is held with the first and second fingers of the user's hand, and wherein the ratio of the curvature of the circular arc shape of the second circular arc portion to the curvature of the circular arc shape of the first circular arc portion is 1.3 or more.

3. The power tool as defined in claim 1, wherein the holding part has a third circular arc portion formed on the body housing having a horizontal section of a circular arc shape and formed contiguously to the second circular arc portion on a tool side surface and wherein the holding part includes a recessed portion which is recessed inward in a lateral direction of the tool and formed contiguously to the third circular arc portion on the front end side of the body housing forward of the third circular arc portion.

4. The power tool as defined in claim 3, wherein the recessed portion is recessed 1.0 mm or more inward with respect to the third circular arc portion.

5. A hand-held power tool comprising:

a body housing, a tool mounting part to which a tool bit is mounted, the tool mounting part provided on a front end of the body housing, a driving mechanism that is housed within the body housing and drives the tool bit, a handgrip that extends from the body housing in a direction transverse to the axial direction of the tool bit and is adapted to be held by user's first to fifth fingers, an operating part that is provided on a grip front portion of the handgrip and is depressed by user's finger in order to drive the driving mechanism, a holding part which is pressed forward toward the tool bit, while being held with first and second fingers of user's hand on a rear end of the body housing and a circular arc portion having a horizontal section of a circular arc shape extending in an axial direction relative to the tool bit on a rear end of the holding part, characterized in that the circular arc shape of the circular arc portion is configured to have such a curvature that the circular arc portion is held in close contact with a web part of the user's hand between the first and second fingers when the holding part is held with the first and second fingers of the user's hand and to have the curvature ranging from 30 mm to 35 mm.

* * * * *